United States Patent [19]

Noma et al.

[11] Patent Number: 5,017,658

[45] Date of Patent: May 21, 1991

[54] DYEABLE POLYPROPYLENE FIBERS FOR CLOTHES

[75] Inventors: Takeshi Noma, Moriyama; Tadao Matsumoto, Takatsuki; Taizo Sugihara, Ohmihachiman, all of Japan

[73] Assignee: Chisso Corporation, Ohsaka, Japan

[21] Appl. No.: 237,780

[22] Filed: Aug. 29, 1988

[30] Foreign Application Priority Data

Sep. 22, 1987 [JP] Japan ..... 62-237770

[51] Int. Cl.[5] ..... C08L 23/32; C08L 33/14; C08J 7/12; C08J 7/14

[52] U.S. Cl. ..... 525/195; 525/194

[58] Field of Search ..... 525/194, 195

[56] References Cited

U.S. PATENT DOCUMENTS 3,395,198 7/1968 Taniguchi et al. ..... 260/897

FOREIGN PATENT DOCUMENTS 849612 8/1970 Canada .
46-12537 3/1971 Japan .
58-149389 11/1983 Japan .
59-76919 6/1984 Japan .

OTHER PUBLICATIONS

English Abstract of Japanese Patent Application No. 59-76919 as provided by Derwent.
English Abstract of Japanese Patent Application No. 59-149389 as provided by Derwent.
English Abstract of Japanese Patent Application No. 46-12537 as provided by Derwent.

*Primary Examiner*—Carman J. Seccuro
*Attorney, Agent, or Firm*—Fay, Sharpe, Beall, Fagan, Minnich & McKee

[57] ABSTRACT

Dyeable polypropylene (PP) fibers for clothes having improved processing properties such as spinning properties, knitting or weaving properties, dyeability are provided, which fibers are obtained by having (a) a 5-20C alkyl phosphate salt or (b) a mixture thereof with an adduct of ethylene oxide to a 6-20C fatty acid in a proportion of the adduct of 1-90% by weight, attached onto dyeable PP fibers obtained by blending a copolymer of an aminoalkyl acrylate with ethylene with a PP and carrying out melt-spinning using the blend as at least one component of the resulting dyeable PP fibers, the amount of (a) or (b) attached onto the fibers in terms of % by weight of the fibers being adjusted so as to satisfy the following expression:

$$0.5 \times \sqrt{d} \leqq \text{attached amount} \leqq 0.25\sqrt{d}$$

wherein d represents the denier of single fiber.

3 Claims, No Drawings

DYEABLE POLYPROPYLENE FIBERS FOR CLOTHES

BACKGROUND OF THE INVENTION

1. Field of the Invention

This invention relates to dyeable polypropylene fibers for clothes. More particularly it relates to dyeable polypropylene fibers having a finishing agent attached thereonto at the time of their processing.

2. Description of the Related Art

As to dyeable polypropylene fibers for clothes, Japanese patent publication No. Sho 46-12537/1971 discloses a product obtained by blending polypropylene with a copolymer of ethylene with an aminoalkyl acrylate expressed by the formula

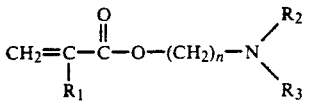

wherein $R_1$ represents hydrogen atom or methyl group; $R_2$ and $R_3$ each represent hydrogen atom or an alkyl group of 1 to 4 carbon atoms; and n represents an integer of 1 to 4, and melt-spinning the resulting blend. Further, Japanese patent application laid-open No. Sho 59-76919/1984 discloses composite fibers comprising the abovementioned dyeable polypropylene fibers as a constituting component thereof.

On the other hand, the production of polypropylene fibers for clothes includes fiber-processing steps such as spinning step, weaving step, etc., and it necessary at these steps to reduce friction between fibers and metals and at the same time have a suitable friction retained between fibers; thus fiber-finishing agents have been used.

It is possible to apply to dyeable polypropylene fibers, paraffin waxes, mineral oils, etc. which are finishing agents generally used for polypropylene fibers for commercial civil materials, but the amount of such substances sticked is large (for example, 0.5 to 0.7% by weight based on the weight of raw fibers of 2 deniers); hence although spinning properties and knitting or weaving properties are improved, there have been raised such problems that dyeability and fastness are reduced, uneven dyeing, knitting defects and oil-stain of machines are liable to occur.

Further, in place of the above process, for example a process has been carried out that an oil used only for spinning is adhered onto raw polypropylene fibers, followed by spinning the resulting fibers and then oiling the spun fibers for knitting or weaving, but in such a case, washing for scouring or oil removal is required after the knitting or weaving; hence there is a drawback that operations are complicated.

SUMMARY OF THE INVENTION

The object of the present invention is to provide dyeable polypropylene fibers for clothes having processing properties such as spinning properties, knitting or weaving properties, dyeability, etc. improved by attaching a fiber-finishing agent suitable to dyeable polypropylene fibers onto raw polypropylene fibers.

The present inventors have made extensive research in order to solve the above-mentioned problems of the prior art. As a result, we have found that the problems can be solved by attaching a specified fiber-finishing agent in a specified quantity onto dyeable polypropylene fibers, and have achieved the present invention.

The present invention resides in; dyeable polypropylene fibers for clothes having (a) an alkyl phosphate salt of 5 to 20 carbon atoms or (b) a mixture of an adduct of ethylene oxide to a fatty acid of 6 to 20 carbon atoms with said alkyl phosphate salt in a proportion of said adduct of 1 to 90% by weight, attached onto dyeable polypropylene fibers obtained by blending a copolymer of an aminoalkyl acrylate with ethylene with a polypropylene and carrying out melt-spinning using the resulting blend as at least one component of the resulting dyeable polypropylene fibers, the amount of said (a) or (b) attached onto said dyeable polypropylene fibers in terms of % by weight based on the weight of said dyeable polypropylene fibers being adjusted so as to satisfy the following expression:

$$0.05 \times \sqrt{d} \leqq \text{attached amount} \leqq 0.25\sqrt{d}$$

wherein d represents the denier of single fiber.

DETAILED DESCRIPTION OF PREFERRED EMBODIMENTS

The dyeable polypropylene fibers used in the present invention are those obtained by blending a copolymer of an aminoalkyl acrylate expressed by the formula

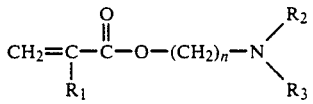

wherein $R_1$ represents hydrogen atom or methyl group; $R_2$ and $R_3$ each represent hydrogen atom or an alkyl group of 1 to 4 carbon atoms; and n represents an integer of 1 to 4, with ethylene, with a polypropylene and carrying out melt-spinning using the resulting blend as at least one component of the resulting dyeable polypropylene fibers.

The dyeable polypropylene fibers refer to not only ordinary yarns but also composite yarns comprising the above-mentioned component. The quantity of the above-mentioned copolymer used is preferred to be in the range of 1 to 10% by weight based on the weight of the polypropylene. Further, the copolymer is preferred to contain 1.8 to 4% by weight of a nitrogen component.

Examples of the above aminoalkyl acrylate are N,N-dimethylaminoethyl acrylate, N,N-dimethylaminoethyl methacrylate, N,N-diethylaminoethyl acrylate, N,N-diethylaminoethyl methacrylate, N,N-dimethylaminoisopropyl acrylate, N,N-dimethylaminoisopropyl methacrylate, N,N-dimethylamino-n-butyl acrylate, N,N-dimethyl amino-n-butyl methacrylate, etc. Among these, N,N-dimethylaminoethyl methacrylate and N,N-diethylaminoethyl methacrylate are preferred.

As to the melt-spinning in the present invention, any process may be employed as far as the abovementioned raw materials are heat-melted and shaped into fiber form; thus the fiber form may be any of circular form, odd-shaped form, composite form, etc.

As to the fiber-finishing agent used in the present invention, the above-mentioned (a) an alkyl phosphate salt of 5 to 20 carbon atoms are higher alcohol phosphate salts expressed by the formula

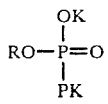

wherein R represents an alkyl group of 5 to 20 carbon atoms, and concrete examples thereof are potassium salt of hexylphosphate, potassium salt of octylphosphate, potassium salt of dodecylphosphate, etc.

Further, as to the fiber-finishing agent used in the present invention, the above-mentioned (b) an adduct of ethylene oxide to a fatty acid of 6 to 20 carbon atoms refers to adducts obtained by adding ethylene oxide (EO) to a saturated or unsaturated fatty acid of 6 to 20 carbon atoms such as lauric acid, oleic acid, etc., preferably in a proportion of EO of 2 to 25% by mol. Concrete examples thereof are oleic acid-EO 10 mols adduct, lauric acid-EO 20 mols adduct, fatty acids of 12 to 16 carbon atoms-EO 5 to 20 mols adducts, etc.

The above-mentioned (a) or (b) as the fiberfinishing agent in the present invention is attached when the dyeable polypropylene fibers are melt-spun or when the spun fibers are stretched, and the amount thereof attached (% by weight) is required to satisfy the following expression:

$$0.05 \times \sqrt{d} \leqq \text{attached amount} \leqq 0.25 \times \sqrt{d}$$

wherein d represents the denier of single fiber. If the attached amount is out of the above-mentioned range, it is impossible to obtain superior spinning properties, knitting or weaving properties and dyeability.

Since these fiber-finishing agents have a hydrophilic group on one hand and also have a hydrocarbon radical having a very strong affinity to polypropylene on the other hand, they are easily water-soluble and can attach well to polypropylene. Further, since they have a hydrophilic group, they are easily dissolved into a dye bath at the usual dyeing so that uneven dyeing, etc. do not occur.

The present invention will be described in more detail by way of Examples.

EXAMPLES 1-7 AND COMPARATIVE EXAMPLES 1-9

An aminoalkyl acrylate-ethylene copolymer (SUMIEPOCK F-522 (trademark of product made by Sumitomo Chemical Company); melt index MI: 53) was blended in 8% by weight with a polypropylene (melt flow rate: 30), followed by melt-extruding the blend at a spinning temperature of 230° C. and an extrusion rate of 80 g/min. to obtain unstretched filaments having an unstretched denier of 6.5 d. At that time, one of the fiber-finishing agents indicated in the Table 1 was respectively attached onto the filaments in the form of 5% by weight aqueous solution by means of a touch roll. The filaments were stretched to 3.25 times to original length at 80° C., followed by crimping these and cutting to a length 51 mm to prepare staple fibers of 2 d/f. The staple fibers were made up into spun yarns of count No. (cotton count No.) $30^s$ in a conventional manner, followed by knitting the spun yarns into a knit of gauge 22 by circular rib knitting at a yarn-feeding rate of 180 m/min. In this case, at the time of spinning and at the time of knitting, no additional oiling was carried out. The knit was then dyed with C.I. acid Red 114 and sewn to obtain an under wear. The test results of spinning properties, knitting properties and dyeability at that time are shown in Table 1. As seen from these results, the fibers of the present invention have superior spinning properties, knitting properties and dyeability. In addition, the symbols in Table 1 indicate the following cases, respectively:

Mark *** represents a case where no trouble occurred at the time of production;

Mark ** represents a case where many defects were observed in the product;

Mark * represents a case where production was utterly impossible; and

Mark — represents a case where since production was impossible at the prior step, the tests could not be carried out.

Further, the dyeing process was carried out as follows:

A test sample was placed in a dye bath consisting of an aqueous solution containing 2% by weight of C.I. acid Red 114 and 2% by weight of sodium salicylate and adjusted to a pH of 3.2 with formic acid, in a liquor ratio of 1:50, followed by raising the temperature from 50° C. up to its boiling point, boiling the sample at the boiling state for 30 minutes, washing the resulting sample with water for 1 to 2 minutes, soaping it in an aqueous solution of Peretex WA-800 (tradename of product made by Miyoshi Yushi Company) in a concentration of 5 g/l for 15 minutes, further washing it with water for 2 to 3 minutes and drying.

TABLE 1

| | Denier (d) | Fiber-finishing agent | Attached amount (wt. %) | Spinning properties | Knitting properties | Dyeability |
|---|---|---|---|---|---|---|
| Example 1 | 2 | Oleic acid-EO10 mol adduct 90 wt. % $C_6$ alkyl phosphate K salt 10 wt. % | 0.2 | *** | *** | *** |
| Example 2 | 2 | E-40(*1) | 0.1 | *** | *** | *** |
| Example 3 | 2 | E-40(*1) | 0.35 | *** | *** | *** |
| Example 4 | 5 | E-40(*1) | 0.12 | *** | *** | *** |
| Example 5 | 5 | E-40(*1) | 0.55 | *** | *** | *** |
| Example 6 | 5 | Oleic acid-EO10 mol adduct 90 wt. % $C_6$ alkyl phosphate K salt 10 wt. % | 0.2 | *** | *** | *** |
| Comp. ex. 1 | 2 | PK-100(*2) | 0.2 | * | — | — |
| Comp. ex. 2 | 2 | P-688(*3) | 0.2 | ** | * | — |
| Comp. ex. 3 | 2 | E-40(*1) | 0.06 | * | — | — |
| Comp. ex. 4 | 2 | E-40(*1) | 0.07 | ** | ** | *** |
| Comp. ex. 5 | 2 | E-40(*1) | 0.38 | ** | ** | *** |
| Comp. ex. 6 | 2 | E-40(*1) | 0.45 | ** | * | — |
| Comp. ex. 7 | 5 | E-40(*1) | 0.1 | * | — | — |
| Comp. ex. 8 | 5 | E-40(*1) | 0.57 | * | — | — |
| Comp. ex. 9 | 5 | Oleic acid-EO10 mol adduct 90 wt. % | 0.1 | ** | * | — |

TABLE 1-continued

| | Denier (d) | Fiber-finishing agent | Attached amount (wt. %) | Spinning properties | Knitting properties | Dyeability |
|---|---|---|---|---|---|---|
| Comp. ex. 10 | 5 | $C_6$ alkyl phosphate K salt 10 wt. %<br>Oleic acid-EO10 mol adduct 90 wt. %<br>$C_6$ alkyl phosphate K salt 10 wt. % | 0.57 | ** | * | — |

(*1) $C_8$, $C_{12}$ alkyl phosphate K salt (made by Yiyoshi Yushi Company)
(*2) Ester of polyethylene glycol (PEG 600) with oleic acid (made by Miyoshi Yushi Company)
(*3) Tradename of product made by Sanyo Kasei Company Further, products obtained from the dyeable polypropylene fibers for clothes (Examples 1-6) had no knitting defects and no problem was raised in the tests of dyeability and fastness to washing according to JIS-L-0844-A-2 method, and abrasion resistance according to JIS-L-0849 by means of abrader II type. As compared with the above results, knots or uneven dyeing occurred in the resulting yarns in Comparative examples.

Since the dyeable polypropylene fibers for clothes of the present invention are superior in the processing properties such as spinning properties, knitting or weaving properties, dyeability, etc., it is possible to obtain superior cloth products without uneven dyeing at the time of piece dyeing, knitting defects, etc. Further, since the finishing agent is attached at the step of the raw fibers and no additional oiling is required at the time of spinning and knitting or weaving, it is possible to improve processing properties such as spinning properties, knitting or weaving properties, dyeability, etc. and also it is possible to produce dyeable polypropylene fibers for clothes which fibers are stable and applicable to spinning of usual chemical or synthetic fibers.

What we claim is:

1. Dyeable polypropylene fibers for clothes comprising:

a fiber-finishing agent including a mixture of an adduct obtained by adding ethylene oxide to a saturated or unsaturated fatty acid of 6-20 carbon atoms in a proportion of ethylene oxide of 2 to 25% by mol with an alkyl phosphate salt in a proportion of said adduct of 1-90% by weight, the fiber finishing agent attached onto dyeable polypropylene fibers obtained by blending a copolymer of an amino alkyl acrylate with ethylene with a polypropylene and carrying out melt-spinning using the resulting blend as at least one component of the resulting dyeable polypropylene fibers, the amount of said fiber-finishing agent mixture attached onto said dyeable polypropylene fibers in terms of percent by weight based on the weight of said dyeable polypropylene fibers being adjusted so as to satisfy the following express:

$$0.05 \times \sqrt{d} \leqq \text{attached amount} \sqrt{d} \leqq 0.25$$

wherein d represents the denier of the single fiber.

2. Dyeable polypropylene fibers for clothes according to claim 1, wherein said alkyl phosphate salt is expressed by the formula

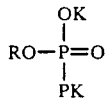

wherein R represents an alkyl group of 5 to 20 carbon atoms.

3. Dyeable polypropylene fibers for clothes according to claim 1, wherein said dyeable polypropylene are those obtained by blending a copolymer of an aminoalkyl acrylate expressed by the formula

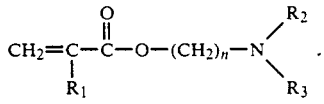

wherein $R_1$ represents hydrogen atom or methyl group; $R_2$ and $R_3$ each represent hydrogen atom or an alkyl group of 1 to 4 carbon atoms; and n represents an integer of 1 to 4, with ethylene, with a polypropylene and carrying out melt-spinning using the resulting blend as at least one component of the resulting dyeable polypropylene fibers.

* * * * *

UNITED STATES PATENT AND TRADEMARK OFFICE

CERTIFICATE OF CORRECTION

PATENT NO. : 5,017,658

DATED : May 21, 1991

INVENTOR(S) : Noma, et al.

It is certified that error appears in the above-identified patent and that said Letters Patent is hereby corrected as shown below:

Column 6, line 18, "$\sqrt{d} \leqq 0.25$" should read --$\leqq 0.25 \times \sqrt{d}$--.

Signed and Sealed this

Tenth Day of May, 1994

Bruce Lehman

*Attest:*

BRUCE LEHMAN

*Attesting Officer*

*Commissioner of Patents and Trademarks*